US005662174A

United States Patent [19]

Vermilyer

[11] Patent Number: 5,662,174

[45] Date of Patent: Sep. 2, 1997

[54] BATTERY POWERED PALM RATCHET TOOL

[76] Inventor: Gary M. Vermilyer, Rte. #2 Box 384, Winamac, Ind. 46996

[21] Appl. No.: 753,848

[22] Filed: Dec. 2, 1996

[51] Int. Cl.[6] ..... B25B 13/46

[52] U.S. Cl. ..... 173/13; 173/2; 173/170; 81/58; 81/60; 81/177.1; 310/50

[58] Field of Search ..... 173/2, 4, 11, 13, 173/18, 170, 171; 81/58, 60, 177.1; 310/47, 50

[56] References Cited

U.S. PATENT DOCUMENTS

| | | | |
|---|---|---|---|
| 2,440,834 | 5/1948 | Sims, Jr. | 173/13 |
| 2,569,244 | 9/1951 | Larson | 173/2 |
| 3,372,781 | 3/1968 | Fulton | 81/58 |
| 3,957,096 | 5/1976 | Rodman | 81/58.3 |
| 4,488,460 | 12/1984 | Ballone et al. | 81/60 |
| 4,791,837 | 12/1988 | Main | 81/177.1 |
| 5,289,885 | 3/1994 | Sakoh | 173/2 |
| 5,538,089 | 7/1996 | Sanford | 173/2 |

*Primary Examiner*—Scott A. Smith

[57] ABSTRACT

A battery powered palm ratchet tool including a hemispherical palm grip. The palm grip has an upper body with a gripping ring and an under side interconnected to a stop. The upper body encases a battery and a motor powered by the battery. The upper body has a plurality of teardrop-shaped sections interconnected by a plurality of ridges. The plurality of ridges bulge outwardly beyond the teardrop-shaped sections and create an enhanced gripping surface on the upper body of the palm grip. The palm grip has an axial opening within the upper body and stop for receiving a shaft. The shaft is rotatably mounted within the axial opening and driven by the motor. The shaft is compressible within the axial opening for activating the motor and actuation of the shaft. The palm grip is positioned within one hand of a user for use on torquing an item.

8 Claims, 3 Drawing Sheets

BATTERY POWERED PALM RATCHET TOOL

BACKGROUND OF THE INVENTION

1. Field of the Invention

The present invention relates to a battery powered palm ratchet tool and more particularly pertains to providing a battery powered ratchet tool sized for fitting within the palm of a hand and for torquing bolts in hard to reach places.

2. Description of the Prior Art

The use of a ratchet tool is known in the prior art. More specifically, Ratchet tools heretofore devised and utilized for the purpose of torquing bolts are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,435,398 to Juan discloses an electrical wrench. U.S. Pat. Des. 352,645 to Ichikawa discloses an electric ratchet wrench. U.S. Pat. No. 5,194,774 to Abo, Kikuchi and Osada discloses an electric-powered tool. U.S. Pat. Des. 316,216 to Gierke and Somers discloses a battery-operated ratchet wrench. U.S. Pat. No. 4,262,562 to MacNeil discloses a golf spike wrench and handle. Lastly, U.S. Pat. No. 3,957,096 to Rodman discloses a combination hand tool.

While these devices fulfill their respective, particular objectives and requirements, the aforementioned patents do not describe battery powered palm ratchet tool that is a compact structure that fits in the palm of one hand for torquing bolts in hard to reach places.

In this respect, the battery powered palm ratchet tool according to the present invention substantially departs from the conventional concepts and designs of the prior art, and in doing so provides an apparatus primarily developed for the purpose of providing a battery powered ratchet tool sized for fitting within the palm of a hand and for torquing bolts in hard to reach places.

Therefore, it can be appreciated that there exists a continuing need for a new and improved battery powered palm ratchet tool which can be used for providing a battery powered ratchet tool sized for fitting within the palm of a hand and for torquing bolts in hard to reach places. In this regard, the present invention substantially fulfills this need.

SUMMARY OF THE INVENTION

In view of the foregoing disadvantages inherent in the known types of ratchet tools now present in the prior art, the present invention provides an improved battery powered palm ratchet tool. As such, the general purpose of the present invention, which will be described subsequently in greater detail, is to provide a new and improved battery powered palm ratchet tool and method which has all the advantages of the prior art and none of the disadvantages.

To attain this, the present invention essentially comprises a hemispherical palm grip. The palm grip has an upper body with a gripping ring and an under side that is interconnected to a stop. The upper body encases a battery and a motor powered by the battery. The upper body has a plurality of teardrop-shaped sections interconnected by a plurality of ridges. The plurality of ridges bulge outwardly beyond the teardrop-shaped sections for creating an enhanced gripping surface on the upper body of the palm grip. The palm grip has an axial opening within the upper body and stop for receiving a shaft. The shaft is rotatably mounted within the axial opening and driven by the motor. The shaft is compressible within the axial opening for activating the motor for actuation of the shaft. The shaft has an interior end positioned within the upper body and the motor, and an exterior end projecting beyond the stop of the palm grip. The exterior end of the shaft has a ball dent for coupling with a variety of torque-operated tool heads. The palm grip is positioned within one hand of a user and the shaft is coupled to one of the torque-operated tool heads for torquing an item. Also, the gripping ring of the palm grip has a pair of recharge contacts symmetrically attached. Each recharge contact is in electrical communication with the battery encased within the upper body. Additionally, the motor is a reversible motor for actuating the shaft of the palm grip. The motor has a switch for controlling the direction for rotation. The switch is attached to the under side of the palm grip. Included is a generally rectangular housing. The housing has a base portion with two short planar walls, one long planar wall and a front wall projecting therefrom and ending at a top portion. The housing has a concave opening within and accessible through the front wall and the top portion. The front wall has a concave portion leading into the concave opening of the housing. The concave opening is sized for receiving the palm grip in a horizontal orientation with the stop of the palm grip projecting from the concave portion of the front wall. Lastly, the concave opening of the housing has an interior wall with a pair of transmitting contacts projecting therefrom and spaced from the concave portion of the front wall. The two short planar walls, the one long planar wall and the front wall form an interior area within the housing. The interior area has a transformer within. The transformer has a power cord and a pair of cables. The power cord extends from the transformer and through the long planar wall. One of each of the pair of cables is capable of being in electrical communication with one of the transmitting contacts. The transmitting contacts are in electrical communication with the recharging contacts of the palm grip, when the palm grip is positioned within the housing. The battery of the palm grip is recharged when the palm grip is seated within the housing.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved battery powered palm ratchet tool which has all of the advantages of the prior art ratchet tools and none of the disadvantages.

It is another object of the present invention to provide a new and improved battery powered palm ratchet tool which may be easily and efficiently manufactured and marketed.

It is further object of the present invention to provide a new and improved battery powered palm ratchet tool which is of durable and reliable constructions.

An even further object of the present invention is to provide a new and improved battery powered palm ratchet tool which is susceptible of a low cost of manufacture with regard to both materials and labor, and which accordingly is then susceptible of low prices of sale to the consuming public, thereby making such battery powered palm ratchet tool economically available to the buying public.

Even still another object of the present invention is to provide a battery powered palm ratchet tool for providing a battery powered ratchet tool sized for fitting within the palm of a hand and for torquing bolts in hard to reach places.

Lastly, it is an object of the present invention to provide a new and improved A battery powered palm ratchet tool including a hemispherical palm grip. The palm grip has an upper body with a gripping ring and an under side interconnected to a stop. The upper body encases a battery and a motor powered by the battery. The upper body has a plurality of teardrop-shaped sections interconnected by a plurality of ridges. The plurality of ridges bulge outwardly beyond the teardrop-shaped sections and create an enhanced gripping surface on the upper body of the palm grip. The palm grip has an axial opening within the upper body and stop for receiving a shaft. The shaft is rotatably mounted within the axial opening and driven by the motor. The shaft is compressible within the axial opening for activating the motor and actuation of the shaft. The palm grip is positioned within one hand of a user for use on torquing an item.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figures 1, 2:
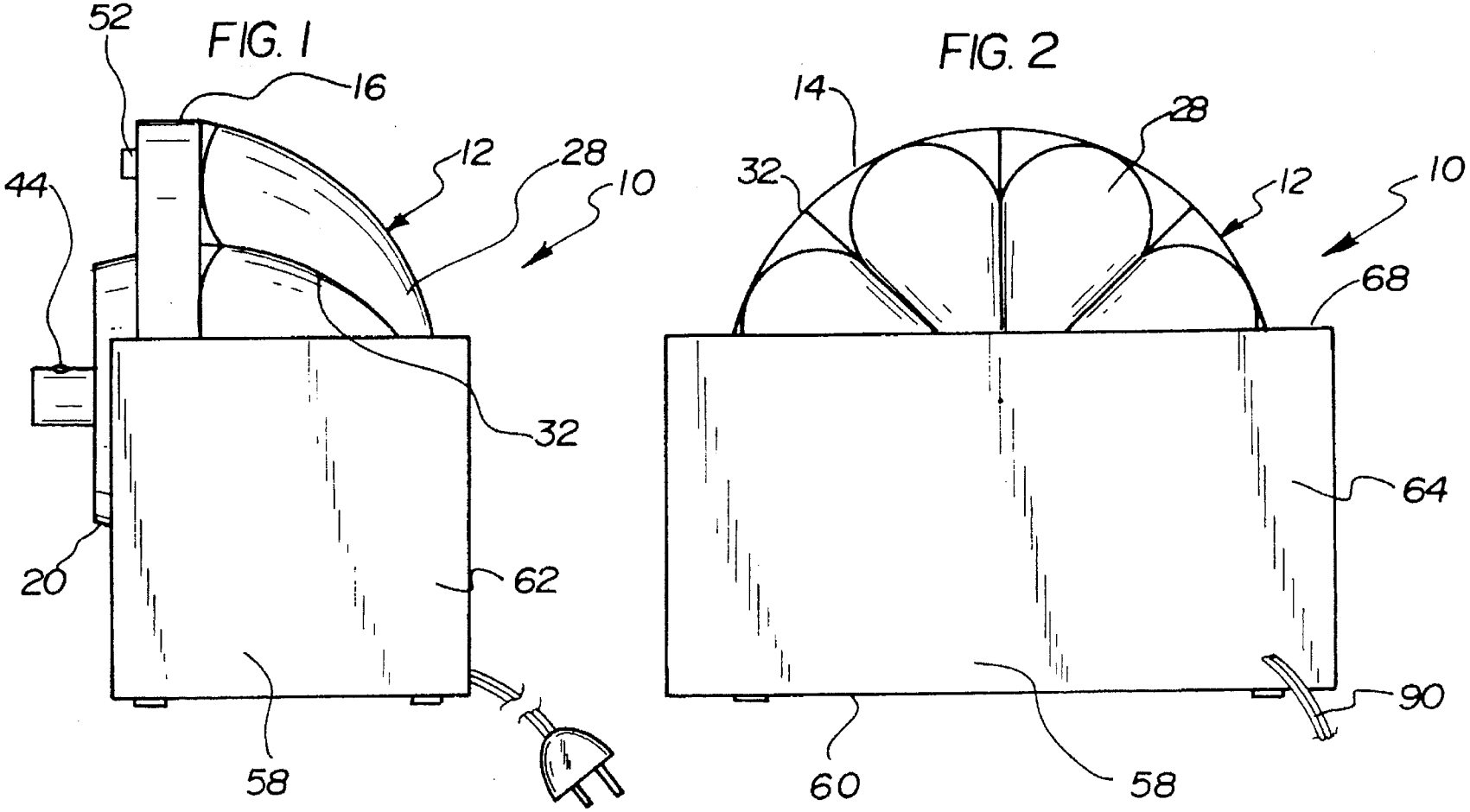
FIG. 1 is a perspective view of the preferred embodiment of the battery powered palm ratchet tool seated within the housing in accordance with the principles of the present invention.
FIG. 2 is a rear view of the palm ratchet seated within the housing of the present invention.
Figure 3:
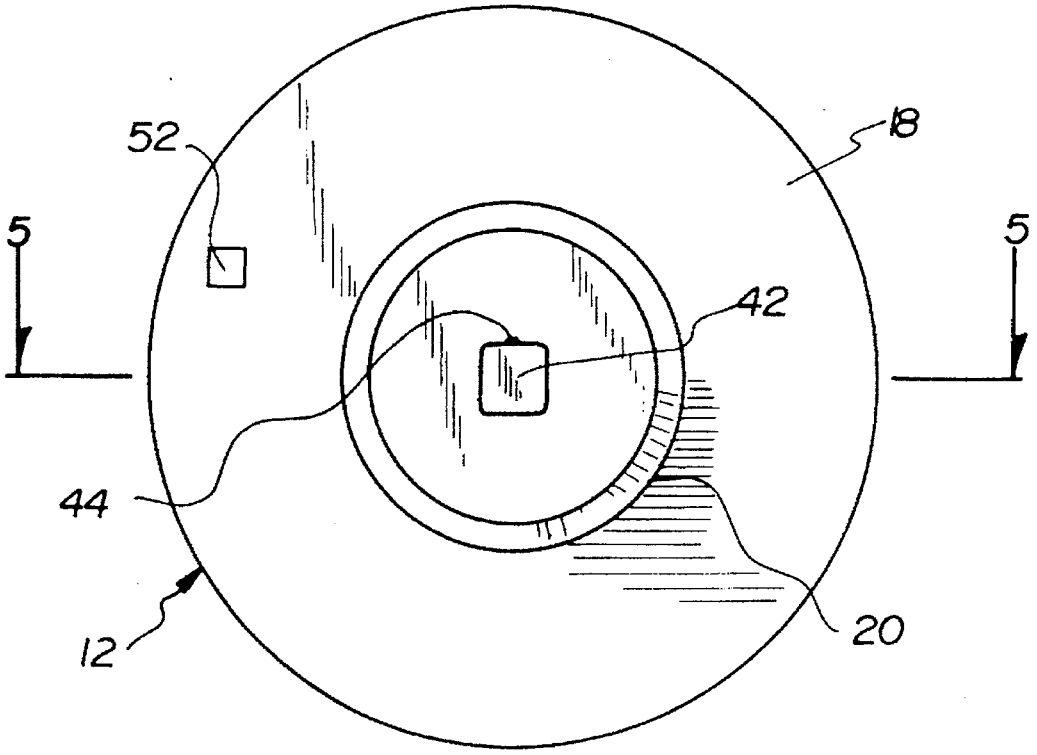
FIG. 3 is a bottom view of the palm ratchet of the present invention.
Figure 4:
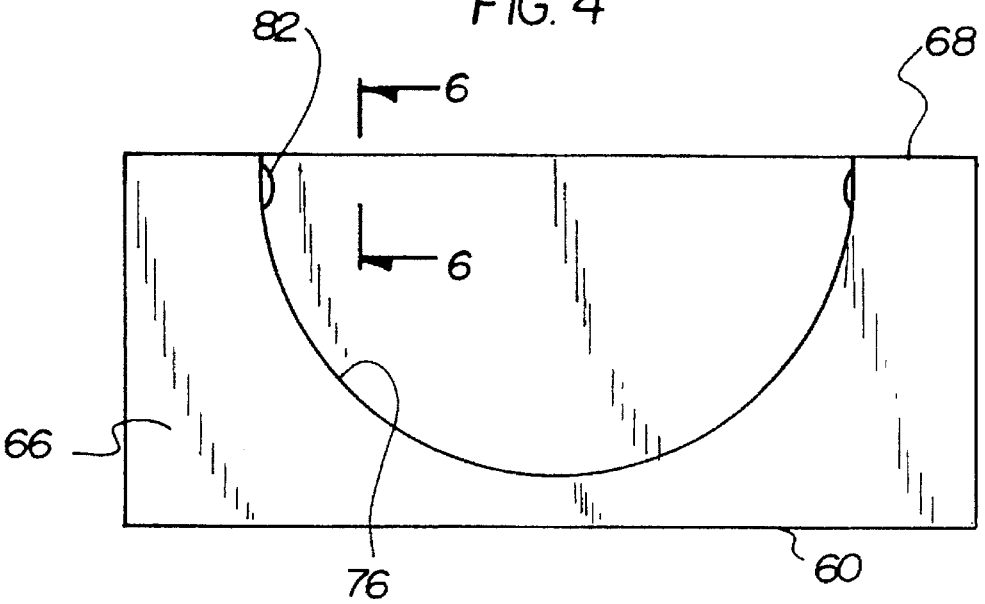
FIG. 4 is a frontal view of the housing of the present invention.

With reference now to the drawings, and in particular to FIG. 1 thereof, the preferred embodiment of the new and improved battery powered palm ratchet tool embodying the principles and concepts of the present invention and generally designated by the reference numeral 10 will be described.

The present invention, the battery powered palm ratchet tool 10 is comprised of a plurality of components. Such components in their broadest context include a palm grip, a motor, a shaft and a housing. Such components are individually configured and correlated with respect to each other so as to attain the desired objective.

Specifically, the present invention includes a hemispherical palm grip 12 that may be formed of a rigid plastic. The palm grip has an upper body 14 with a gripping ring 16 and an under side 18 that is interconnected to a stop 20. The upper body encases a battery 24 and a motor 26 that is powered by the battery. The upper body has a plurality of teardrop-shaped sections 28 interconnected by a plurality of ridges 32. The plurality of ridges bulge outwardly beyond the teardrop-shaped sections and help to create an enhanced gripping surface on the upper body of the palm grip. The enhanced gripping surface provides a comfortable and secure fit of the palm grip with the palm of one hand.

Also, the palm grip 12 has an axial opening 36 within the upper body and stop for receiving a shaft 37. In the present figures the axial opening has a generally rectangular shape. The axial opening is not limited to this shape, and may be hexagonal, pentagonal or octagonal. Likewise, the shaft of the present invention is generally rectangular but, the shape of the shaft may vary with the axial opening. The shaft is rotatably mounted within the axial opening and driven by the motor 26. The axial opening has a plurality of bearings 38 positioned within and spaced apart to engage the shaft as it rotates. The shaft is compressible within the axial opening for activating the motor for actuation of the shaft.

Figure 5:
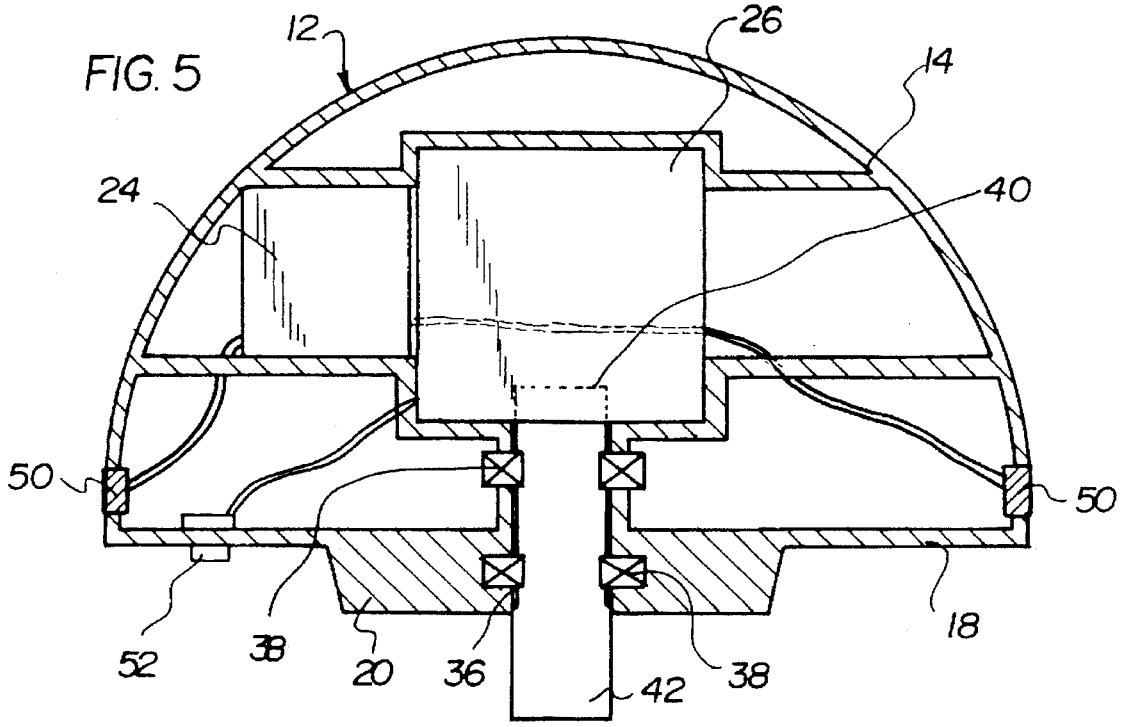
FIG. 5 is a cross-sectional view of the palm grip of the present invention taken along line 5—5 of FIG. 3.

Additionally, the shaft has an interior end 40 and an exterior end 42. The interior end, as seen in FIG. 5, is positioned within the upper body and the motor. The exterior end is shown to project beyond the stop of the palm grip. Finally, the exterior end of the shaft has a ball dent 44, as shown in FIG. 1. The ball dent is used to couple the shaft with a variety of torque-operated tool heads. The palm grip is positioned within one hand of a user and the shaft is coupled to one of the torque-operated tool heads for torquing an item such as a bolt. In operation the user would couple a torque-operated tool head to the shaft, place the palm grip with one hand and couple the tool head with the item to be torqued. The user would then press down to cause the shaft to be compressed within the motor. Compressing the shaft into the motor will activate the motor, which in turn, will cause the rotation of the shaft.

A best illustrated in FIG. 5, the gripping ring 16 of the palm grip has a pair of recharge contacts 50. The pair of recharge contacts are symmetrically spaced apart one from the other along the gripping ring and attached thereto. Each recharge contact is in electrical communication with the battery 24 encased within the upper body 14.

The motor of the present invention is a reversible motor for actuating the shaft of the palm grip. The motor has a switch 52, as shown in FIG. 1. The switch provides control for the direction of rotation of the motor as it rotates the shaft. The switch is attached to the under side 18 of the palm grip 12.

Figure 6:
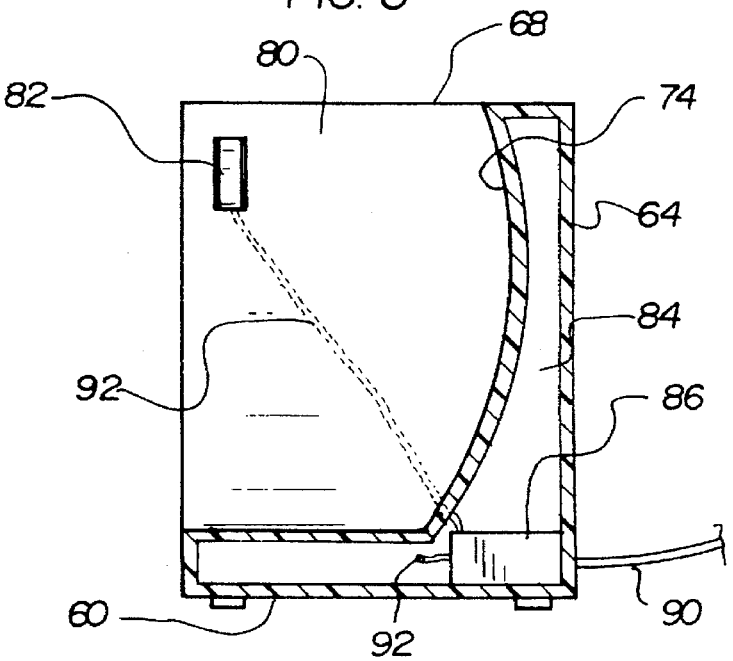
FIG. 6 is a cut-away section view of the housing of the present invention taken along line 6—6 of FIG. 4.

Included with the-palm grip is a generally rectangular housing 58. The housing has a base portion 60 with two short planar walls 62, one long planar wall 64 and a front wall 66 projecting therefrom and ending at a top portion 68. The housing, as shown in FIG. 6, has a concave opening 74 within. The concave opening is accessible through the front wall and the top portion. The front wall has a concave portion 76 that leads into the concave opening of the housing. The concave opening is sized to receive the palm grip 12 in a horizontal orientation. When the palm grip is placed within the housing, the stop of the palm grip, a shown in FIG. 1, projects from the concave portion of the front wall.

Lastly, the concave opening 74 of the housing has an interior wall 80. The interior wall has a pair of transmitting contacts 82 that project therefrom and are spaced from the concave portion 76 of the front wall. The two short planar walls, the one long planar wall and the front wall form an interior area 84 within the housing 58. The interior area, as seen in FIG. 6, has a transformer 86. The transformer has a power cord 90 and a pair of cables 92. The power cord extending from the transformer and through the long planar wall 64. One of each of the pair of cables is capable of being in electrical communication with one of the transmitting contacts. The transmitting contacts are in electrical communication with the recharging contacts of the palm grip, when the palm grip is positioned within the housing. The battery of the palm grip is recharged, for reuse, when the palm grip is seated within the housing.

The present invention battery powered palm ratchet tool is a battery-powered, compactly designed ratchet tool that will allow a person to torque bolts in hard to reach places. The pal grip of the invention has a hemispherical shape that fits comfortably and securely in the palm of a hand. The shaft of the present invention is steel and rotates in a clockwise direction and counter-clockwise direction. The rotation of the shaft is dependant upon the rotation of the motor, which is controlled manually by the switch. The present invention may be provided with a holster for carrying the palm grip on a tool belt.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved battery powered palm ratchet tool for torquing items in hard to reach places comprising, in combination:

a hemispherical palm grip having an upper body with a gripping ring and an under side being interconnected to a stop, the upper body encasing a battery and a motor powered by the battery, the upper body having a plurality of teardrop-shaped sections interconnected by a plurality of ridges, the plurality of ridges bulging outwardly beyond the teardrop-shaped sections for creating an enhanced gripping surface on the upper body of the palm grip, the palm grip having an axial opening within the upper body and stop for receiving a shaft, the shaft being rotatably mounted within the axial opening and driven by the motor, the shaft being compressible within the axial opening for activating the motor for actuation thereof, the shaft having an interior end positioned within the upper body and the motor, and an exterior end projecting beyond the stop of the palm grip, the exterior end of the shaft having a ball dent for coupling with a variety of torque-operated tool heads, the palm grip being positioned within one hand of a user and the shaft being coupled to one of the torque-operated tool heads for torquing an item;

the gripping ring of the palm grip having a pair of recharge contacts symmetrically attached thereto, each recharge contact being in electrical communication with the battery encased within the upper body;

the motor being a reversible motor for actuating the shaft of the palm grip, the motor having a switch for controlling the direction for rotation, the switch being attached to the under side of the palm grip;

a generally rectangular housing having a base portion with two short planar walls, one long planar wall and a front wall projecting therefrom and ending at a top portion, the housing having a concave opening within and accessible through the front wall and the top portion, the front wall having a concave portion leading into the concave opening of the housing, the concave opening being sized for receiving the palm grip in a horizontal orientation with the stop of the palm grip projecting from the concave portion of the front wall; and the concave opening of the housing having an interior wall with a pair of transmitting contacts projecting therefrom and spaced from the concave portion of the front wall, the two short planar walls, the one long planar wall and the front wall form an interior area within the housing, the interior area having a transformer therein, the transformer having a power cord and a pair of cables, the power cord extending from the transformer and through the long planar wall, one of each of the pair of cables capable of being in electrical communication with one of the transmitting contacts, the transmitting contacts being in electrical communication with the recharging contacts of the palm grip when the palm grip being positioned within the housing, the battery of the palm grip being recharged when the palm grip being seated within the housing.

2. A battery powered palm ratchet tool comprising:

a hemispherical palm grip having an upper body with a gripping ring and an under side being interconnected to a stop, the upper body encasing a battery and a motor powered by the battery, the upper body having a plurality of teardrop-shaped sections interconnected by a plurality of ridges, the plurality of ridges bulging outwardly beyond the teardrop-shaped sections for creating an enhanced gripping surface on the upper body of the palm grip, the palm grip having an axial opening within the upper body and stop for receiving a shaft, the shaft being rotatably mounted within the axial opening and driven by the motor, the shaft being compressible within the axial opening for activating the motor for actuation thereof, the palm grip being positioned within one hand of a user.

3. The battery powered palm ratchet tool as set forth in claim 2, wherein the shaft having an interior end positioned within the upper body and the motor, and an exterior end projecting beyond the stop of the palm grip, the exterior end of the shaft having a ball dent for coupling with a variety of torque-operated tool heads, and the shaft being coupled to one of the torque-operated tool heads for torquing an item.

4. The battery powered palm ratchet tool as set forth in claim 2, wherein the gripping ring of the palm grip having a pair of recharge contacts symmetrically attached thereto, and each recharge contact being in electrical communication with the battery encased within the upper body.

5. The battery powered palm ratchet tool as set forth in claim 2, wherein the motor being a reversible motor for actuating the shaft of the palm grip, the motor having a switch for controlling the direction for rotation, the switch being attached to the under side of the palm grip.

6. The battery powered palm ratchet tool as set forth in claim 4, further including:

a generally rectangular housing having a base portion with two planar walls, one long planar wall and a front wall projecting therefrom and ending at a top portion, the housing having a concave opening within and accessible through the front wall and the top portion, the front wall having a concave portion leading into the concave opening of the housing, and the concave opening being sized for receiving the palm grip in a horizontal orientation with the stop of the palm grip projecting from the concave portion of the front wall.

7. The battery powered palm ratchet tool as set forth in claim 6, wherein the concave opening of the housing having an interior wall with a pair of transmitting contacts projecting therefrom and spaced from the concave portion of the front wall, the two short planar walls, the long planar wall and the front wall form an interior area within the housing, the interior area having a transformer therein, and the transformer having a power cord and a pair of cables.

8. The battery powered palm ratchet tool as set forth in claim 7, wherein the power cord of the transformer extending from the transformer and through the long planar walls, one of each of the pair of cables being in electrical communication with one of the transmitting contacts, the transmitting contacts being in electrical communication with the recharging contacts of the palm grip when the palm grip being positioned within the housing, and the battery of the palm grip being recharged when the palm grip being seated within the housing.

* * * * *